United States Patent [19]

Littlejohn et al.

[11] 4,406,351

[45] Sep. 27, 1983

[54] EMERGENCY ESCAPE SYSTEM FOR USE IN MULTISTORIED BUILDINGS

[76] Inventors: Charles E. Littlejohn, 525 Forestdale Dr., N.E., Atlanta, Ga. 30342; Henry D. Cook, 608 Channing Dr., N.W., Atlanta, Ga. 30308

[21] Appl. No.: 234,826

[22] Filed: Feb. 13, 1981

[51] Int. Cl.[3] ..... A62B 1/02

[52] U.S. Cl. ..... 182/47; 182/51; 182/142

[58] Field of Search ..... 182/142, 143, 46, 47, 182/51, 52, 129

[56] References Cited

U.S. PATENT DOCUMENTS

| | | | |
|---|---|---|---|
| 211,875 | 2/1879 | Winkless | 182/142 |
| 481,888 | 8/1892 | Bergeron et al. | 182/142 |
| 665,707 | 1/1901 | Tromanhauser | 182/142 |
| 1,421,609 | 7/1922 | Sturm et al. | 182/37 |
| 1,518,318 | 12/1924 | Fletcher | 182/142 |
| 2,112,837 | 4/1938 | Fisher | 182/142 |
| 3,750,686 | 8/1973 | Cook | 134/95 |
| 3,831,848 | 8/1974 | Cook | 239/104 |
| 3,854,550 | 12/1974 | Shingler | 182/142 |
| 4,209,077 | 6/1980 | Yul | 182/42 |

*Primary Examiner*—Reinaldo P. Machado

[57] ABSTRACT

An emergency escape system with escape module suspended from a cable or the like along but unattached to the exterior of a multistoried building, such cable being powered by any suitable mechanism incorporating hoisting and pumping devices such as the ground unit described in co-inventor Cook's U.S. Pat. No. 3,750,686, or the winding drum and water pump of a fire truck or other emergency vehicle, such cable being passed around a pulley supported on the roof of the building, so as to raise the escape module and lower it with encapsulated escapees to a haven. Such escape module is selectively positioned on the side of the building for ingress of escapees and provides such protective and human engineered features as heat shielding of escapees from fire; knotted ropes and handrails for handholds during and after ingress; fluid spray for suppression of fire; water cooling and heat shielding of the floor; total encapsulation of escapees for psychological and safety reasons during rescue; requiring no on-board operator thus avoiding risks to rescue attendants; being of light weight and transportable to permit use on a plurality of multistoried buildings.

3 Claims, 6 Drawing Figures

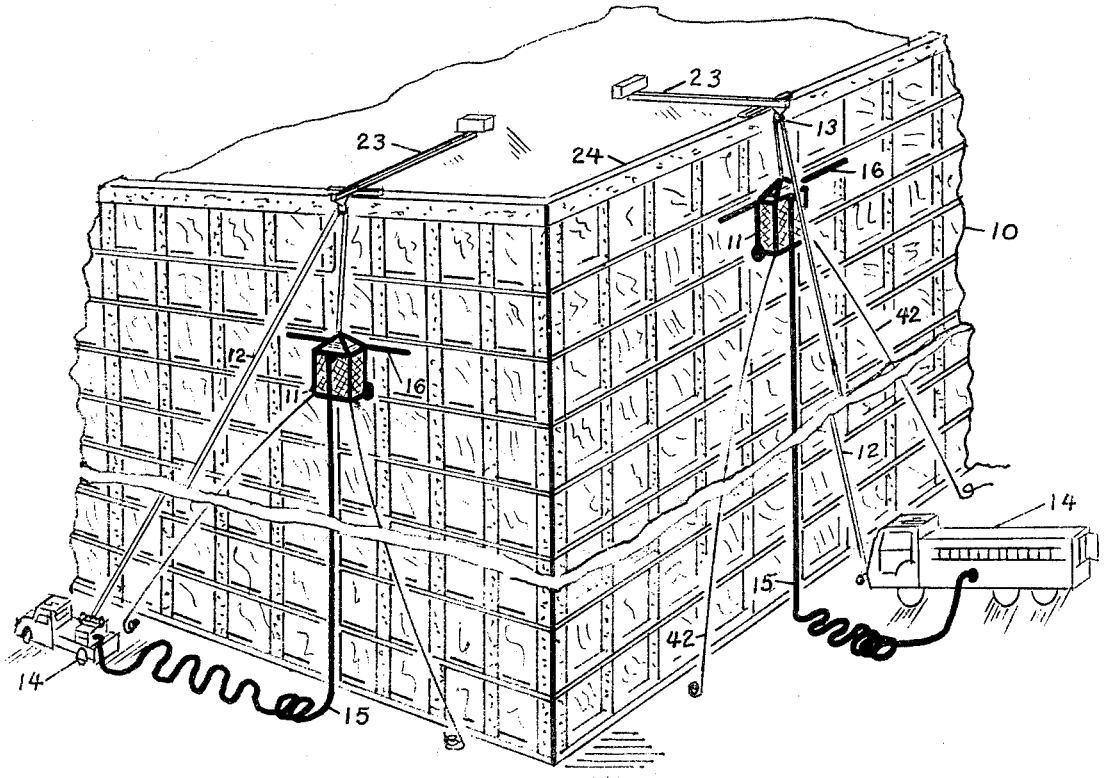
23
23
24
13
16
10
11
42
12
16
11
12
14
15
42
14
15

EMERGENCY ESCAPE SYSTEM FOR USE IN MULTISTORIED BUILDINGS

1. Field of the Invention

This invention generally relates to an emergency escape system for evacuating victims entrapped by disaster in upper stories of multistoried buildings. The present invention is comprised of transportable components suited for use on a plurality of buildings, such components being a cable suspended escape module having active and passive protection and safety features, an attached fluid spray nozzle supply hose, and a pulley beam assembly for supporting and guiding the support cable to any suitable hoisting mechanism. The escape module is elevated to any preselected location where escapees, including those mentally or physically impaired, can enter and be lowered to a haven. Fluid can be supplied by any suitable pumping mechanism to the module spray nozzles for cooling and fire suppression.

2. Description of the Prior Art

Society has witnessed and as a consequence, become fearful of entrappment in upper levels of multistoried hotels, apartments, dormitories and office buildings due to fires, smoke, explosions and such disasters which render elevators, stairwells and such conventional means of exit unusable. Lives are lost not only from entrappment in the basic disaster, but also from the fear induced survival instinct of the endangered to seek escape with makeshift ropes and ladders and to even jump or fall from open or broken windows and balconies. The heights of modern commercial, institutional and residential towers render the old concept of exterior fire escape stairs obsolete. Such stairs as well as endless conveyors, automatic drop ladders, repelling lines, escape chutes and other proposed devices accommodate athletic persons but pose risks to escapees characterized by acrophobia, or children, or the handicapped, or otherwise physically limited, thus unable to hold to such devices or accept suspension at great heights; and such devices are typically impracticable because of weight of complexity.

The present invention proffers a simple, transportable system adaptable to a plurality of multistoried structures; can be positioned at a plurality of escape locations along the building facade; a stabilized platform for easy ingress; encapsulates and further protects escapees for a risk-limited descent; comprises a cooling and fire suppressing fluid spray; and requires no on-board operator.

SUMMARY OF THE INVENTION

The herein described invention overcomes the impracticability, limited adaptability, weight and complexity, safety constraints and psychological deficiencies of prior systems and devices, both conventional and unique.

Therefore, it is an object of the present invention to provide a novel transportable emergency escape system which may be used with a plurality of existing and future multistoried buildings without the need for modifying or creating new designs of building structures.

Another object of the present invention is to provide a versitile escape system comprising a cable-supported escape module, a pulley supporting assembly with attached pulley for the cable adapted to be positioned on the rooftop of the building being evacuated, and a fluid spray nozzle supply hose; such cable being directed by the pulley to any suitable hoisting mechanism for raising and lowering the escape module; and such fluid hose being of sufficient length not to interfere with full movement of the escape module and connected to any suitable pumping mechanism for the supply of cooling and fire suppressing fluid to the escape module.

A further object of the present invention is to provide a unique escape module with a variety of safety and protective features, passive and active, affording psychological and physical accommodations to escapees, yet requiring no on-board operator to be unnecessarily exposed to risks of the present disaster. Such features comprise a sloped roof to deflect falling debris; perforated side and rear walls to contain while admitting fresh breathing air; a floor both shielded and spray cooled to prevent burn injuries to partially clothed escapees; sliding entry doors to afford partial frontal opening for orderly ingress of multiple escapees while affording frontal protection and containment of ingressed escapees; heat shielding of said sliding doors to provide frontal barrier to fire emitting from the building; fluid spray nozzles directing fire suppressing fluid toward fire sources; a plurality of guide wheels to sense and cushion the building facade; elongated poles extending horizontally from the escape module along the building facade to control rotation of the module about the cable axis; guides to deflect the support cable over the escape module toward the hoisting mechanism; and eyelets for attaching guy lines extending to the ground to permit attendants to stabilize the escape module under windy conditions.

A utilization objective of the present invention is to provide an emergency escape system with components of rugged and simple construction suited for rough handling in the exigency of a present disaster and its inherent dangers whereby the escape module can be transported to the site by rescue units or be subject to prolonged storage at the site in preparation for an emergency; and whereby the pulley beam assembly with the support cable can be prepositioned on the roof in prolonged storage in preparation for an emergency or transported along with ancillary equipment by rescue helicopter or other means. It is envisioned that the escape module along with a mechanism for hoisting and pumping of fluids, such as co-inventor Cook's ground control unit as identified in U.S. Pat. No. 3,750,686, can be jointly mounted on an emergency vehicle for transportation to an emergency site such that the module can be placed in use by using the adjacent mounted hoisting mechanism to lift it from the vehicle.

These together with other objects and advantages which will become subsequently apparent reside in the details of construction and operation as more fully hereinafter described and claimed, reference being had to the accompanying drawings forming a part hereof, wherein like numerals refer to like parts throughout, and in which:

FIG. A-2 is a perspective view of a building with two emergency escape systems.

Figure 1:
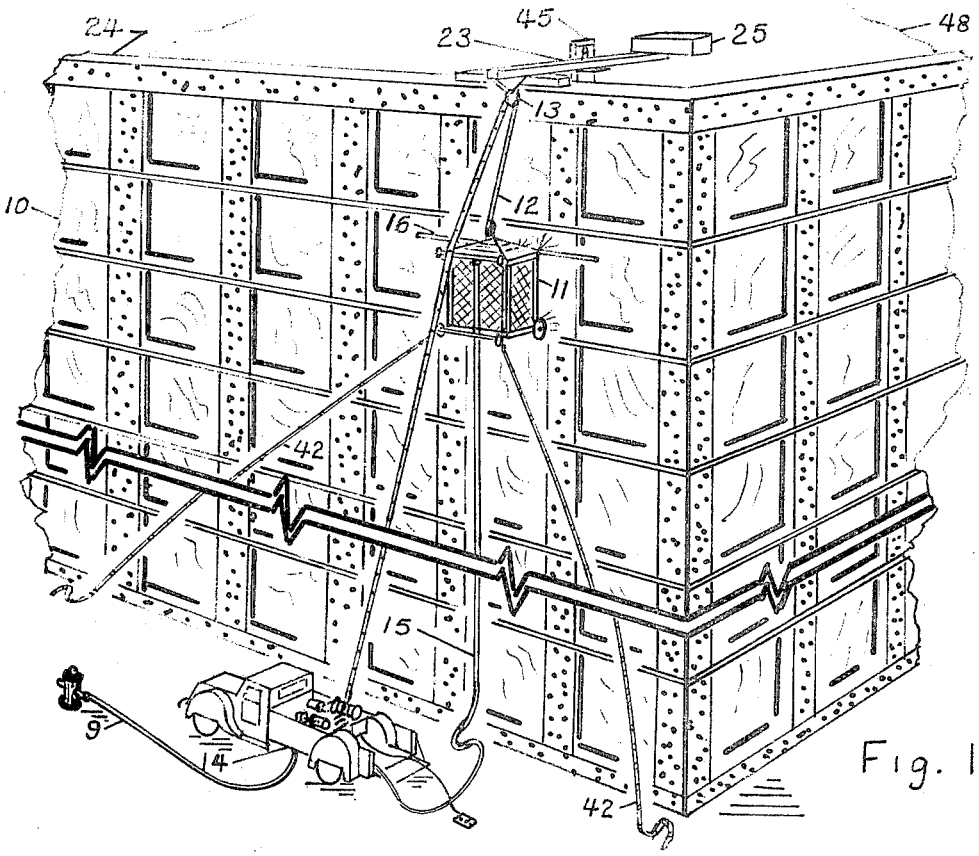
FIG. 1 is a perspective view of the emergency escape system of the present invention depicting the escape module, support cable, pulley beam assembly, fluid hose and guy lines assembled and deployed along the facade and on the roof of multistoried building, such components being appropriately connected to a representative hoisting and pumping mechanism.

Referring now, more particularly, to FIG. 1 of the drawings, the emergency escape system of the present invention is illustrated as it would be utilized to provide access of the escape module to escapees in a random location in the upper levels of a typical multistoried building generally indicated by the numeral 10. Components of the system include the escape module 11 suspended from a flexible high tension member 12, hereinafter a cable, which passes around a pulley 13 supported by a pulley beam assembly 23 located on the roof of the building; additional components include a fluid supply hose 15 and guy lines 42. FIG. 1 further depicts the pulley beam assembly supported on a typical parapet 24 and balanced from the loads on cable 12 by counterweights 25. Any manually operated hand lift device 45 is shown to suggest a practicable mechanism for use in lifting the unloaded pulley beam assembly and relocating it along the perimeter of the roof 48. Any suitable hoisting and pumping device generally indicated by the numeral 14, such as co-inventor Cook's Ground Control Unit described in U.S. Pat. No. 3,750,686 or as may be available on standard fire fighting vehicles, is employed for attachment of cable 12 to the hoisting drum to raise and lower and provide positive braking at rest for the escape module and for attachment of fluid supply hose 15 to the pump pressure line as the source of cooling and fire suppressing fluid for the escape module. Fluid supply hose 15 is of sufficient length to permit unhindered movement of escape module 11 to the uppermost tier of occupied spaces in building 10. Escape module 11 has provisions for attachment of elongated yaw stabilizer poles 16 to constrain rotation of module 11 about the axis of support cable 12; and for attachment of guy lines 42 which extend to the base of the building 10 for use by attendants to stabilize the escape module 11 from wind forces and to unlodge said escape module from ledges and irregularities on the facade of building 10. It is a maxim that the hoisting and pumping mechanism 14 to which the support cable 12 is attached must be weighted to exceed the total weight which would be imposed on support cable 12 by the escape module 11, fluid supply hose 15 and its contained liquid, and the planned maximum encapsulated escapees; further such hoisting and pumping mechanism 14 must incorporate safety devices to sense the load imposed on the cable 12 as escape module 11 approaches its upper limit of travel at pulley 13 and shut down the hoisting operation. Fire extinguishing fluid, typically water, is obtained from a fire hydrant 9 or the tanks of a fire truck, and pumped by the hoisting and pumping mechanism 14 to the fluid supply hose 15.

Figure 2:
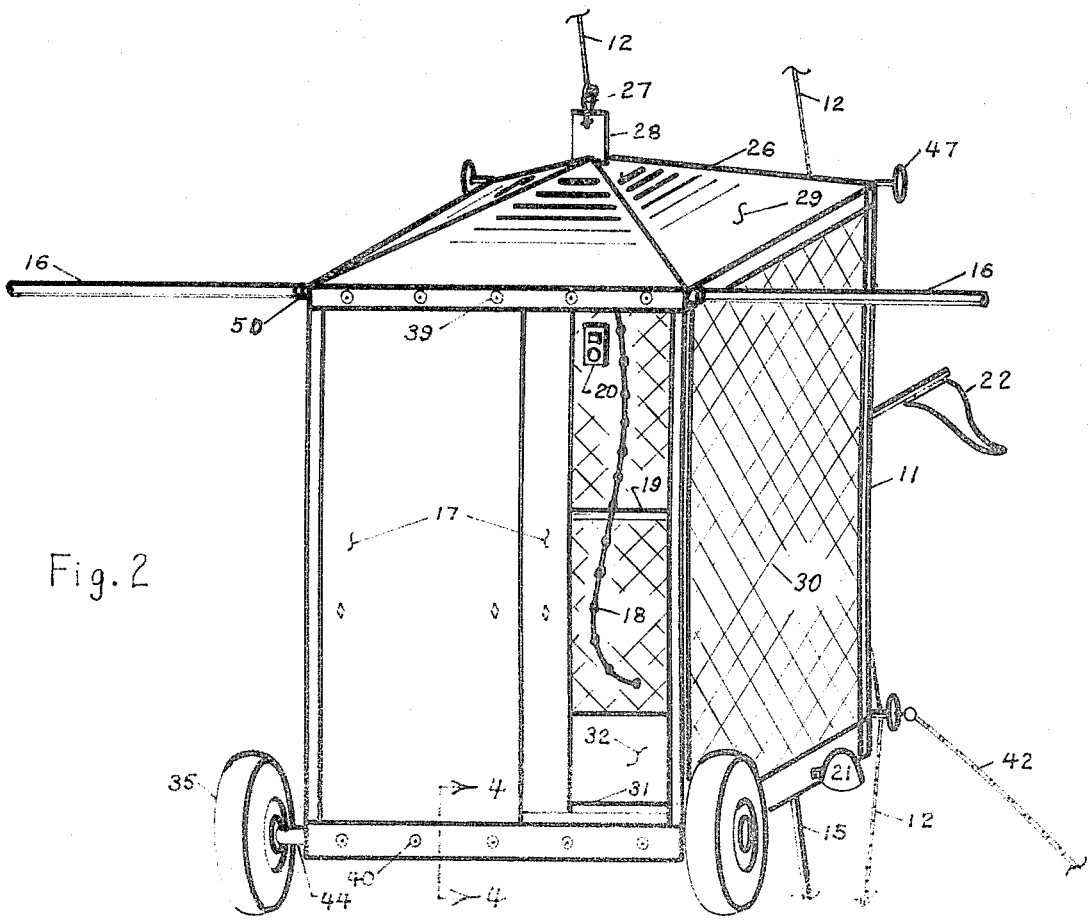
FIG. 2 is a frontal angular view of the emergency escape module as shown in FIG. 1.
Figure 3:
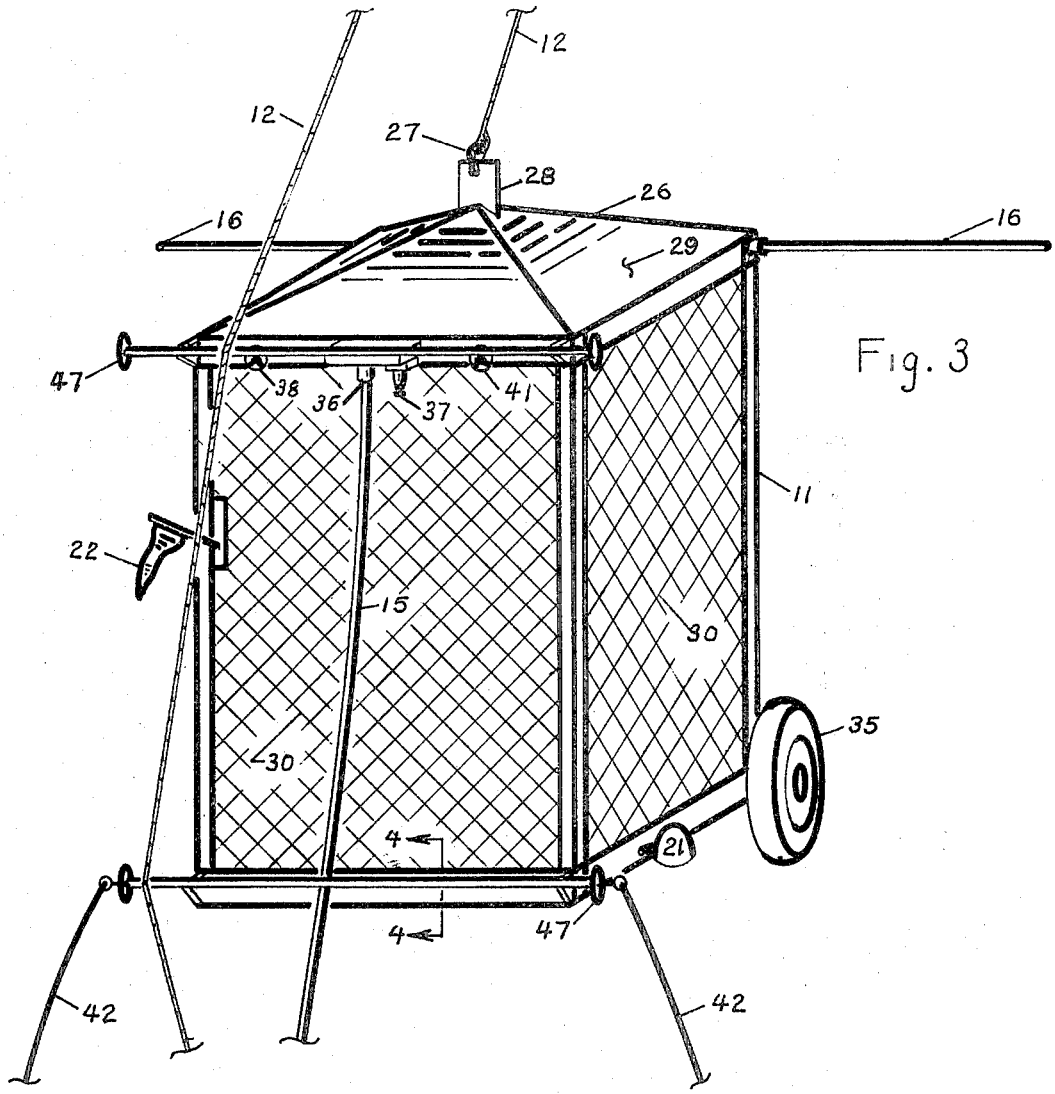
FIG. 3 is a rear angular view of the emergency escape module as shown in FIG. 1.

Referring now to FIG. 2 and FIG. 3, the construction of the escape module 11 associated with the present invention may be more fully appreciated. A support harness 26 is provided for connecting the escape module to the cable 12 by way of a shackle 27 or similar fastening means. Preferrably, the support cable 12 aligns with the center of gravity of the escape module in order to maintain it in a substantially upright orientation during its operation. An anti-tilt elongated rigid verticle member 28 to which cable shackle 27 attaches, is fastened to the support harness 26 by welding or other fastening means; this member senses horizontal tilt forces on cable 12 and tends to return the escape module 11 to a vertical orientation. The support harness 26 is configured in a pyramidal or other sloping shape and covered with a metal shielding 29 to deflect glass or debris falling from the damaged building 10 preventing such debris with its attendant weight from collecting on the escape module 11.

Referring again to FIG. 2 and FIG. 3, the escape module 11 is manufactured from steel, aluminum or other structural shapes connected by welding, bolting or other means to form the structural framework; the framework is covered on sides and rear with perforated sheathing such as expanded metal 30. Attached to the structural framework by welding or other means are axles 44 for mounting guide wheels and threaded or bayonet type joints 50 to which yaw stabilizing poles 16 are attached. Also attached to the structural framework are a plurality of support cable guides 47 fabricated of flanged metal bars or rollers with mounting brackets welded or bolted to the framework.

Sliding doors 17 are manufactured from a structural metal framework and covered with non-perforated sheathing such as sheet metal; the exterior sheathing of the doors are coated or covered with a heat shielding material such as asbestos cloth, ceramics or ablutive material. The doors are provided with rollers or slide shoes 8 of teflon or other low friction material and set in appropriate tracks 31 such that the doors can be opened or closed manually.

As seen in FIG. 2, a plurality of knotted ropes 18 are attached to the escape module structural framework, and in such positions to be accessible to escapees entering through any sliding door opening. Handrails 19 are installed within the module 11 to support encapsulated escapees.

As seen further in FIG. 2 and FIG. 3, a plurality of guide wheels 35 are mounted on the escape module axles 44. The exact location and number of guide wheels 35 may be varied, as required, and the wheels may be manufactured from or covered with heat resistive materials such as teflon. Fluid spray nozzles 40, mounted on the structural framework of the escape module 11 provide spray toward the guide wheels 35 to afford cooling and fire protection. Further, the guide wheels 35 may be fixed or mounted in movable fashion so as to be extendable during movement along the facade and retracted at the rescue location to allow closer positioning of the escape module 11 to the building 10.

Depicted further in FIG. 2 and FIG. 3 is a pair of elongated yaw stabilizing poles 16 mounted on attachment joints 50 on opposite upper frontal corners of escape module 11 such that the poles, being relative rigid and of resilient material, prevent module 11 from yawing or rotating around the axis of support cable 12.

Again in FIG. 2 and FIG. 3, it may be seen that the configuration of the escape module 11 includes provisions for the fluid spray nozzles supply system, including a standard water hose connection 36 for attaching fluid supply hose 15, and internal plumbing directing the fluid by way of a pressure reducing valve 37 to several sets of spray nozzles set within the structural framework for damage protection, one set of nozzles being located over the sliding doors 17, such set identified generally by the numeral 39, the flow of fluid being controlled to these nozzles by a manual control valve 38; another set of nozzles 40 are mounted in the structural framework below the sliding doors 17 and fluid flow is controlled to these nozzles by manual control valve 41; the foregoing nozzles being directed toward the building facade 10 to suppress flames and combustion gases emitting from the building and toward the guide wheels 35 for cooling. A third set of fluid spray nozzles 33 may be better seen in FIG. 4.

Figure 4:
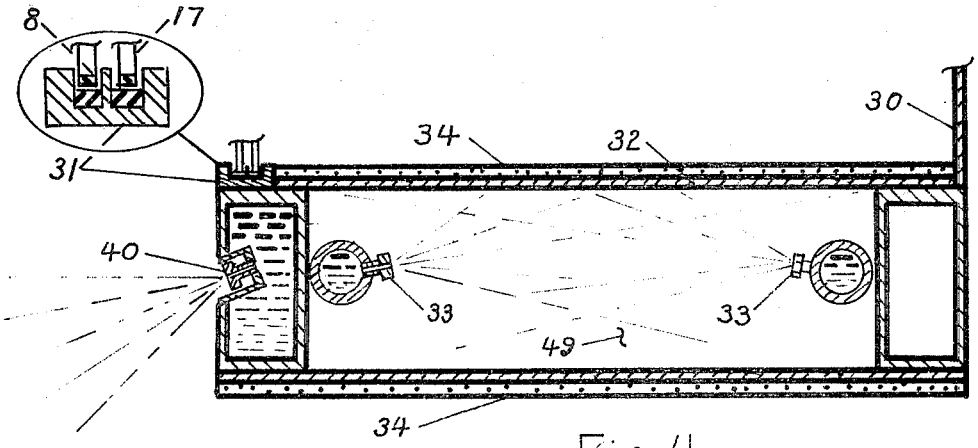
FIG. 4 is a sectional view taken along sections 4—4 of FIG. 2 and FIG. 3 revealing the concept of the floor chamber and fluid nozzles and the sliding door mounting tracks.

Referring to FIG. 4, a cross-sectional view of the floor chamber 49 may be seen. This chamber is formed from structural shapes of the structural framework, and sheet metal in two layers separated sufficently to provide an open chamber for water from fluid spray nozzles 33 to be directed onto the underside of the upper floor surface for cooling. Heat shielding material 34 such as asbestos or ceramic tile is attached to the exterior of the lower floor surface and to the top of the upper or standing floor surface to provide further heat isolation for the purpose of preventing burn injuries to escapees entering the module 11 without shoes or being fully clothed.

Figure 5:
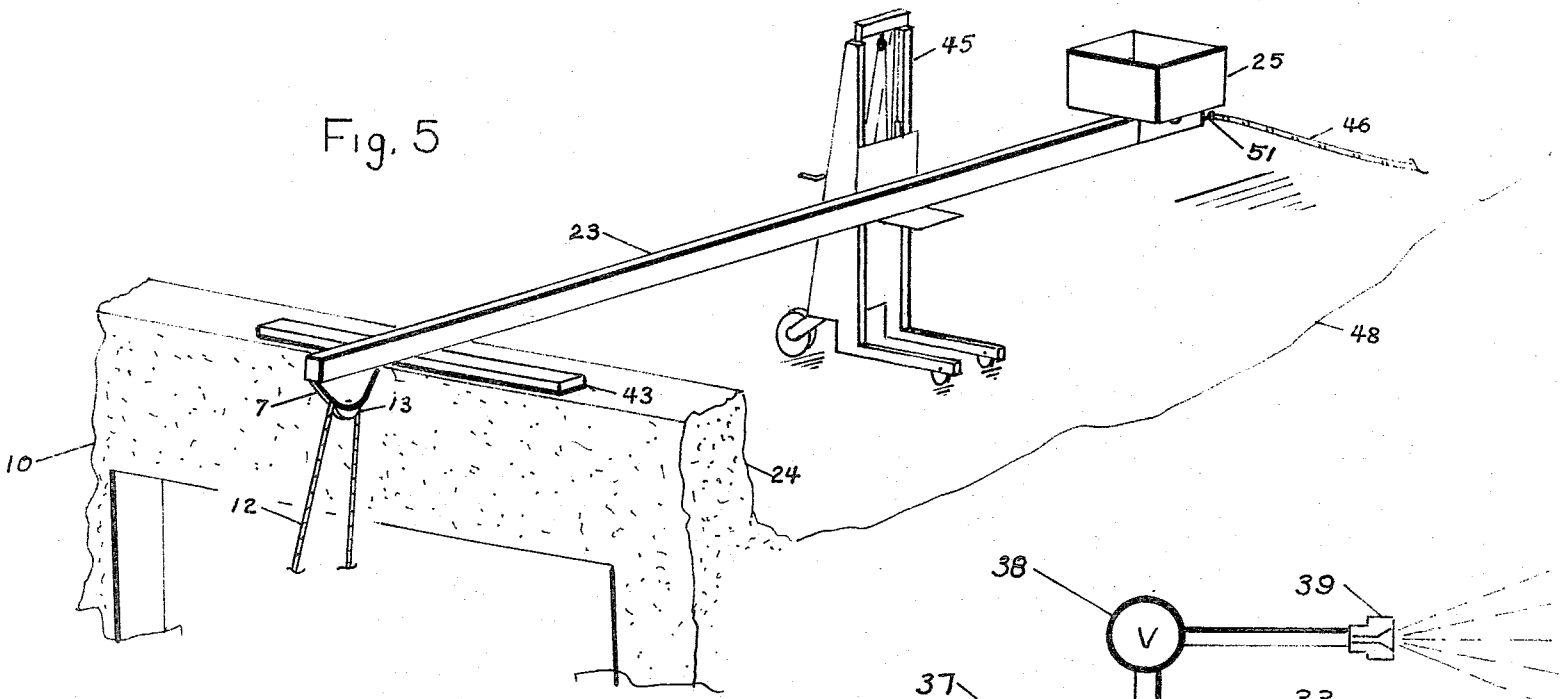
FIG. 5 is a perspective view of the pulley beam assembly as shown in FIG. 1.

Referring to FIG. 5, the pulley beam assembly associated with the present invention may be seen in more detail and includes an elongated support beam 23 made of light weight structural material with an end fitting, a pulley support 7 providing for pulley 13 to be rotatably connected to the one end. A transverse member designated the fulcrum 43 is attached to the beam 23 by welding or other means and as near pulley 13 as practicable so to limit the structural loads moment imposed on the beam 23, to provide an enlarged footprint of said loads on the buidling parapet 24 or roof ledge and to further preclude beam 23 from turning over. Counterbalancing of the load on the pulley 13 is provided by the greater length of the beam 23 extending along the roof 48 and being held by an opposing moment developed by counterweights such as lead bars placed in counterweight container 25 or otherwise attached to the anti-pulley beam end. An eyelet 51 is attached to beam 23 by welding to the counterweight end such eyelet being useful for attaching a safety line 46 such line being further tied to an appropriate structural component of building 10 for added security of the pulley beam assembly.

Referring again to FIG. 5, a standard hand lift truck 45 is seen positioned at pulley beam 23 such that the pulley beam assembly can be lifted and relocated to other positions along the perimeter of the roof 48. Relocation is accomplished only when the escape module 11 is lowered and supported at the base of building 10 and the module weight has been removed from the cable 12.

Pulley beam 23 is of structural strength to carry the imposed static and kinematic loads of the module 11, support cable 12, fluid hose 15 and its contained fluid, and the encapsulated escapees. The size or configuration of the pulley supporting device or its connections with pulley 13 or its attachment or counterbalancing to or on the roof may be varied to accommodate various roof and parapet designs such that the movement of the support cable 12 and escape module 11 around the perimeter of the building roof 48 can be equally implemented.

Figure 6:
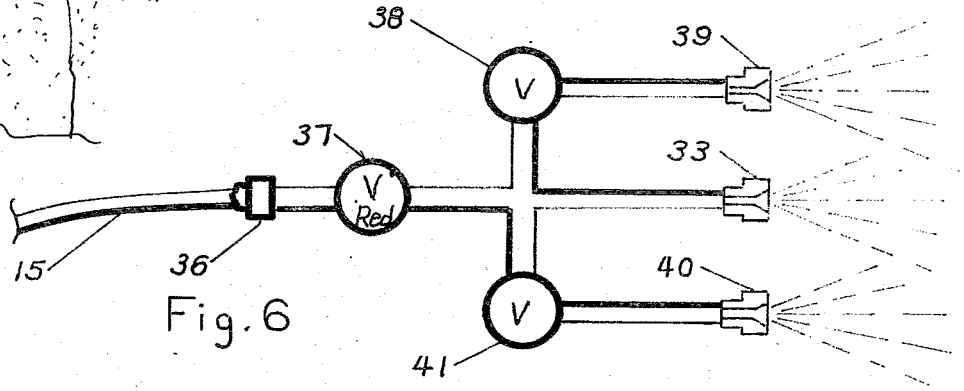
FIG. 6 is a schematic diagram of the fluid flow and control system as shown in FIG. 2, FIG. 3 and FIG. 4.

FIG. 6 is now referred to for the purpose of further explaining the fluid cooling and fire suppression system. This represents the fluid flow system schematically and shows first the fluid supply hose 15 which supplies the fluid under sufficient pressure to overcome static pressure of the substantial water column extending to the greatest heights of multistoried buildings, the friction imposed on the fluid by flow through the substantial length of the hose, and the operating pressure required for proper spray from the nozzles. Hose 15 is attached to the escape module 11 at the connector 36. Fluid is channelled to a pressure reducing valve 37 which provides proper operating fluid pressure to the spray nozzles 33, 39 and 40. Fluid flow is maintained to the floor chamber spray nozzles 33 at any time pumping mechanism 14 is supplying fluid to the system. Manual control valves 38 and 41 are provided to allow shutoff of flow to either set of spray nozzles 39 and 40 respectfully, should either or both flows be unnecessary or impede ingress.

Utilization of the emergency escape system may be further understood by referring now to FIG. 2 and FIG. 3. In the event of an emergency rendering elevators and conventional exits of building 10 unusable, escape module 11 is elevated by support cable 12 to an opening such as a broken window created by candidate escapees. With a sliding door 17 having been opened by rescue attendants prior to raising the module 11, the escapees ingress using knotted ropes 18 as handholds. Handrails 19 are provided for ingressed escapee stability while others enter and during descent. The last escapee having entered, the sliding doors 17 are closed to complete the encapsulation of escapees and to give frontal protection from flames and smoke emitting from building 10. Employing one or more communication devices, the two-way radio 20, the battery powered signal lights 21, or hand flags 22, escapees signal the rescue attendants to lower module 11 to haven. Rescue attendants, using guy lines 42, aide in controlling the descent and guiding the escape module 11 to an appropriate setting sufficiently away from building 10 so to allow room for escapees to exit the escape module 11.

What is claimed as new and desired to be secured by Letters Patent of the United States is as follows:

1. An emergency escape system for use on multistoried buildings to proffer a means of exit for persons entrapped by fire or other disasters, such system comprised of, as articles of manufacture an escape module of special configuration suspended by a flexible high tensile strength structural member, hereinafter a cable a pulley assembly supported on the roof above said module and accommodating said support cable to direct same to any suitable mechanism to raise and lower said module and to further provide positive stopping of such module at any selected elevation a structural framework having a sloped support harness and elongated rigid vertical member to which the support cable is attached, such support harness being covered with solid sheathing to deflect falling debris; such framework being covered on the sides and back with a perforated sheathing to admit fresh breathing air while simultaneously providing a closure wall; such framework accommodating a floor chamber of two separated surfaces with the upper surface for escapee support, both surfaces being covered with a heat shielding material as a heat barrier; such framework further accommodating sliding door tracks for mounting a plurality of doors fitted with rollers or slides to operate within the tracks; such framework also accommodating support structure for attaching building guide wheels, yaw stabilizing poles, support cable guides, and guy line attachments; such framework further adapted to support a fluid hose connection; such framework being further comprised of certain hollow structural members accommodating the flow of fire extinguishing fluid and supporting fluid spray nozzles a fluid dispensing system comprised of a connection for a fluid supply hose, a pressure reducing valve, manual fluid control valves, and plumbing lines to direct fluid under a controlled pressure to a plurality of fluid spray nozzles a plurality of fluid spray nozzles inset within the frontal members of the structural framework to protect said nozzles from damage, such nozzles being set to provide a fluid spray onto the guide wheels for cooling and on flames and combustion products emitting from the building facade a floor chamber, aforesaid, accommodating fluid spray nozzles set to provide a cooling fluid spray on the under side of the floor standing surface a plurality of aforesaid sliding doors covered on their exterior with a suitable heat shielding material as fire barriers, such doors accommodating simultaneous shielding from heat emitting from building fires and ingress when open and full frontal heat shielding and enclosure when closed a plurality of support cable guides to direct said cable from the pulley safely over the escape module and to the hoisting mechanism a plurality of elongated yaw stabilizing poles so attached to sense the building facade and to control the rotation of said escape module about the axis of the support cable a plurality of audio and visual communicating systems for signalling between escapees and rescue attendants.

2. An emergency escape system for use on multistoried buildiings having as a component, an article of manufacture, a cable suspended escape module as set forth in claim 1 which is of such size and weight to be conveniently transportable; is independent of permanent physical attachment to any specific building; is configured to be used on a plurality of multistoried buildings, such buildings being of varying heights and configurations; can be positioned at a plurality of vertical and lateral positions on a plurality of sides of said buildings; and can be expeditiously placed in use at any selected building location.

3. An emergency escape system for use on multistoried buildings having as a component, as an article of manufacture an escape module as set forth in claim 2, said escape module configured to provide total encapsulation of escapees for psychological and safety reasons; to be accommodating to escapees of all psychological and physical attributes; to be dispatched for rescue along the facade of a building with no on-board operating attendant to be exposed to dangers of the present disaster or to add undesirable weight to the system loads of this invention; and requiring no external source of energy for the operation of on-board devices.

* * * * *